US009328514B1

(12) United States Patent
Thompson

(10) Patent No.: US 9,328,514 B1
(45) Date of Patent: May 3, 2016

(54) ROOF-MOUNTED VENT PIPE COVERING APPARATUS, KIT, AND RELATED METHODS

(71) Applicant: Michael Thompson, Manchester, NH (US)

(72) Inventor: Michael Thompson, Manchester, NH (US)

( * ) Notice: Subject to any disclaimer, the term of this patent is extended or adjusted under 35 U.S.C. 154(b) by 0 days.

(21) Appl. No.: 14/641,782

(22) Filed: Mar. 9, 2015

(51) Int. Cl.

| | |
|---|---|
| ***E04D 13/04*** | (2006.01) |
| ***E04D 13/143*** | (2006.01) |
| ***E04D 13/147*** | (2006.01) |
| ***F23J 13/04*** | (2006.01) |

(52) U.S. Cl.
CPC ..... *E04D 13/143* (2013.01); *E04D 13/1476* (2013.01); *F23J 13/04* (2013.01)

(58) Field of Classification Search
CPC ... E04D 13/14; E04D 13/143; E04D 13/1476; F24F 7/02; F23J 13/04
See application file for complete search history.

(56) References Cited

U.S. PATENT DOCUMENTS

| | | | | |
|---|---|---|---|---|
| 1,706,525 | A * | 3/1929 | Gullion | F16L 15/005 285/179 |
| 3,853,042 | A | 12/1974 | Tobiasson | |
| 4,189,989 | A * | 2/1980 | Maze | F24F 7/02 454/368 |
| 4,603,619 | A | 8/1986 | Amphoux | |
| 6,279,272 | B1 * | 8/2001 | Nill, Jr. | E04D 13/1471 285/43 |
| 8,534,013 | B2 * | 9/2013 | Rodriguez, Jr. | F23J 13/08 52/198 |
| 8,615,943 | B2 * | 12/2013 | Rodriguez, Jr. | E04D 13/147 52/198 |
| 8,763,325 | B2 * | 7/2014 | Rodriguez, Jr. | E04D 13/1476 52/198 |
| 8,845,406 | B2 * | 9/2014 | McIver | F24F 7/02 454/367 |
| 2005/0028456 | A1 * | 2/2005 | McLane | E04D 13/1407 52/58 |
| 2006/0211356 | A1 * | 9/2006 | Grassman | F23J 13/08 454/4 |
| 2008/0096480 | A1 * | 4/2008 | Parry | F24F 7/02 454/4 |
| 2010/0255769 | A1 | 10/2010 | Farr | |
| 2011/0275307 | A1 | 11/2011 | McIver | |
| 2013/0328300 | A1 * | 12/2013 | Bond | B26D 3/00 285/42 |

* cited by examiner

*Primary Examiner* — Andrew J Triggs
(74) *Attorney, Agent, or Firm* — Hayes Soloway, PC

(57) ABSTRACT

A vent pipe covering apparatus, kit, and related methods are provided. The vent pipe covering apparatus includes a tubular structure having a first end and a second end, wherein the tubular structure is positioned surrounding an exposed portion of a substantially vertical building roof-mounted vent pipe. A cap is positioned at the first end of the tubular structure, wherein the cap has a closed surface positioned directly above the building roof-mounted vent pipe. A venting structure is positioned in at least one of the tubular structure and the cap. A connection system is positioned between the tubular structure and the building roof-mounted vent pipe proximate to the second end of the tubular structure, wherein the connection system retains the tubular structure stationary relative to the building roof-mounted vent pipe.

9 Claims, 11 Drawing Sheets

ROOF-MOUNTED VENT PIPE COVERING APPARATUS, KIT, AND RELATED METHODS

FIELD OF THE DISCLOSURE

The present disclosure is generally related to a covering device and more particularly is related to a roof-mounted vent pipe covering apparatus, kit, and related methods.

BACKGROUND OF THE DISCLOSURE

Building roof structures typically have one or more openings serving as venting structures to allow gases and other materials to exit the building, and to allow atmospheric air to enter the building. For example, plumbing vents are typically required at all drainage points in a building to exhaust plumbing gases and to allow air to enter the plumbing system to displace water draining into the sewer system. The vents formed within building roofs usually include a venting pipe positioned through a hole within the roof. An interfacing material, such as flashing or a gasket, is positioned between the vent pipe and the hole in the roof to maintain a water-tight seal between the vent pipe and the roof. Gaskets may be constructed from rubbers, plastics, or weather-resistant, durable materials, whereas flashing materials may include lead or other metals. The flashing material or gasket is often interfaced with the roofing shingles or tiles to maintain the water-tight seal.

While conventional vent pipes, venting structures, and venting systems provide adequate functioning, they also have many drawbacks and shortcomings. For example, building roof vents are often positioned in highly visible areas of the building roof, such that they can easily be noticed. The ability to notice a roofing vent is enhanced due to the commonly white-colored venting pipe that contrasts with the commonly darker-colored roofing shingles or tiles. Some building vents, such as dryer vents or stove exhaust vents, can exit through a wall of the building and therefore can enjoy the benefit of aesthetic shields, such as shrubbery, trees, or similar articles to block their unsightly appearance. However, plumbing exhaust vents, colloquially referred to within the industry as 'stinky pipes', are often required to be positioned through a roofing structure and therefore are almost always in highly visible areas.

Additional shortcomings of conventional venting structures include the fact that roof venting pipes often have an opening to the elements, thus lending themselves as attractive places for rodents and other creatures to take up residence. Devices have been made available to cover these openings, but they, too, are often unsightly. Furthermore, many roof venting pipes are positioned with their opening just a foot or two above the roof itself, which can create complications in inclement weather where the height of snow on the roof can surpass the height of the pipe opening. Extending the roof venting pipe further away from the roof is often not a feasible option, since it increases the unsightly view of the pipe. In addition, some existing roof venting pipes are prone to leaking through the gasket or flashing after years of use. Replacing the gasket or flashing can be costly and time-consuming, and can result in the need for new roofing shingles which do not match existing roof shingles or other noticeable, unsightly features on the roof.

Thus, a heretofore unaddressed need exists in the industry to address the aforementioned deficiencies and inadequacies.

SUMMARY OF THE DISCLOSURE

Embodiments of the present disclosure provide a vent pipe covering apparatus. Briefly described, in architecture, one embodiment of the apparatus, among others, can be implemented as follows. A tubular structure has a first end and a second end, wherein the tubular structure is positioned surrounding an exposed portion of a substantially vertical building roof-mounted vent pipe. A cap is positioned at the first end of the tubular structure, the cap having a closed surface positioned directly above the building roof-mounted vent pipe. A venting structure is positioned in at least one of the tubular structure and the cap. A connection system is positioned between the tubular structure and the building roof-mounted vent pipe proximate to the second end of the tubular structure, wherein the connection system retains the tubular structure stationary relative to the building roof-mounted vent pipe.

The present disclosure can also be viewed as providing a vent pipe covering kit. Briefly described, in architecture, one embodiment of the kit, among others, can be implemented as follows. The vent pipe covering kit comprises a tubular structure having a first end and a second end, wherein the tubular structure has a diameter of at least four inches; a cap adapted to be connected to the first end of the tubular structure, wherein the cap has a closed surface, wherein the closed surface is adapted to be positioned intersecting a central axis of the tubular structure when the cap is connected to the tubular structure, wherein a venting structure is formed in at least one of the tubular structure and the cap; and a mechanical connection device adapted to engage between the tubular structure and a building roof-mounted vent pipe to retain the tubular structure stationary relative to the building roof-mounted vent pipe.

The present disclosure can also be viewed as providing methods of covering a building roof-mounted vent pipe. In this regard, one embodiment of such a method, among others, can be broadly summarized by the following steps: positioning a tubular structure having a first end and a second end to surround an exposed portion of a substantially vertical building roof-mounted vent pipe; connecting a cap proximate to the first end of the tubular structure, wherein the cap has a closed surface positioned directly above the building roof-mounted vent pipe; providing a venting structure positioned in at least one of the tubular structure and the cap; and stationarily securing the tubular structure to the building roof-mounted vent pipe with a connection system positioned proximate to the second end of the tubular structure.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
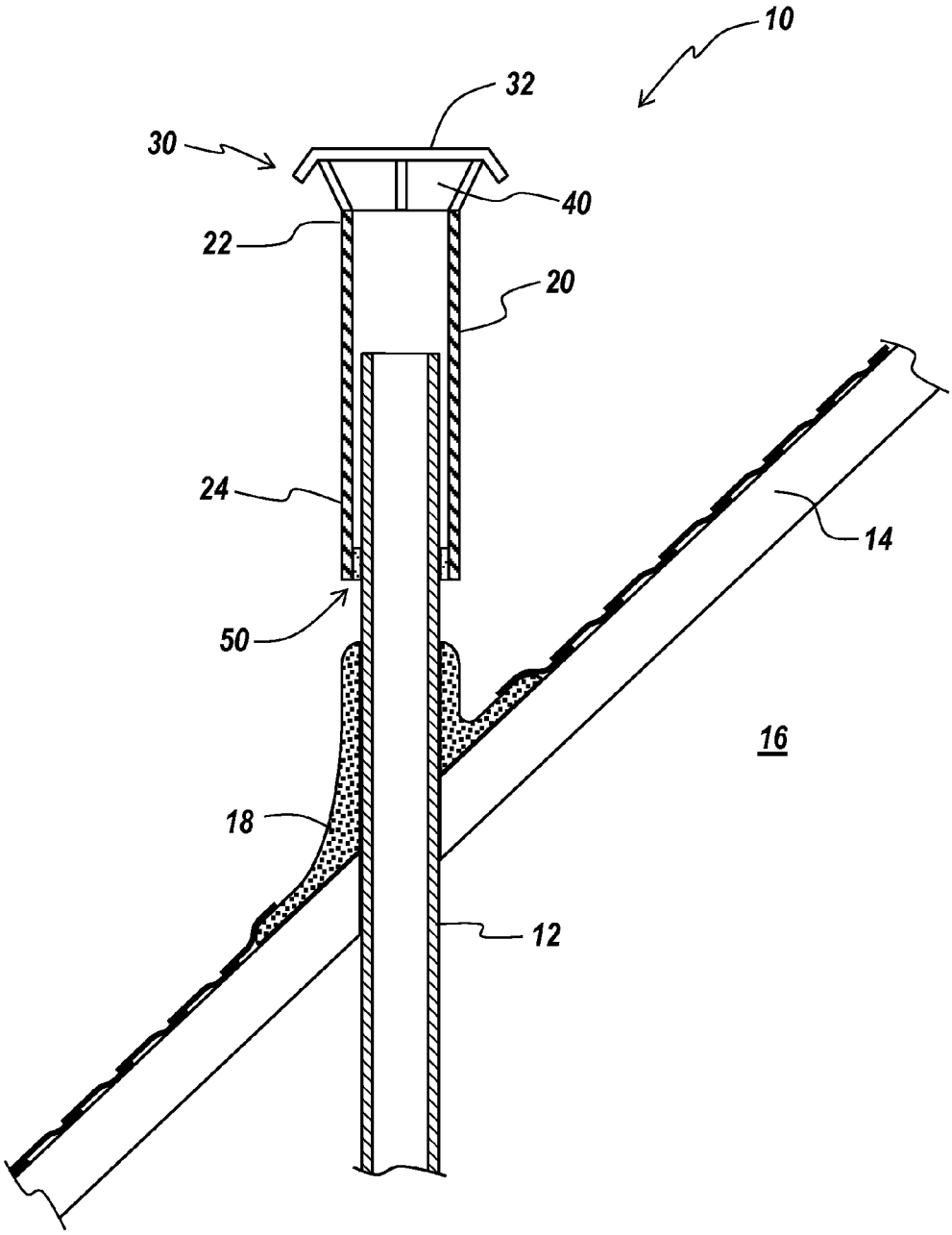
FIG. 1A is a cross-sectional diagrammatical illustration of a vent pipe covering apparatus, in accordance with a first exemplary embodiment of the present disclosure.
Figure 1B:
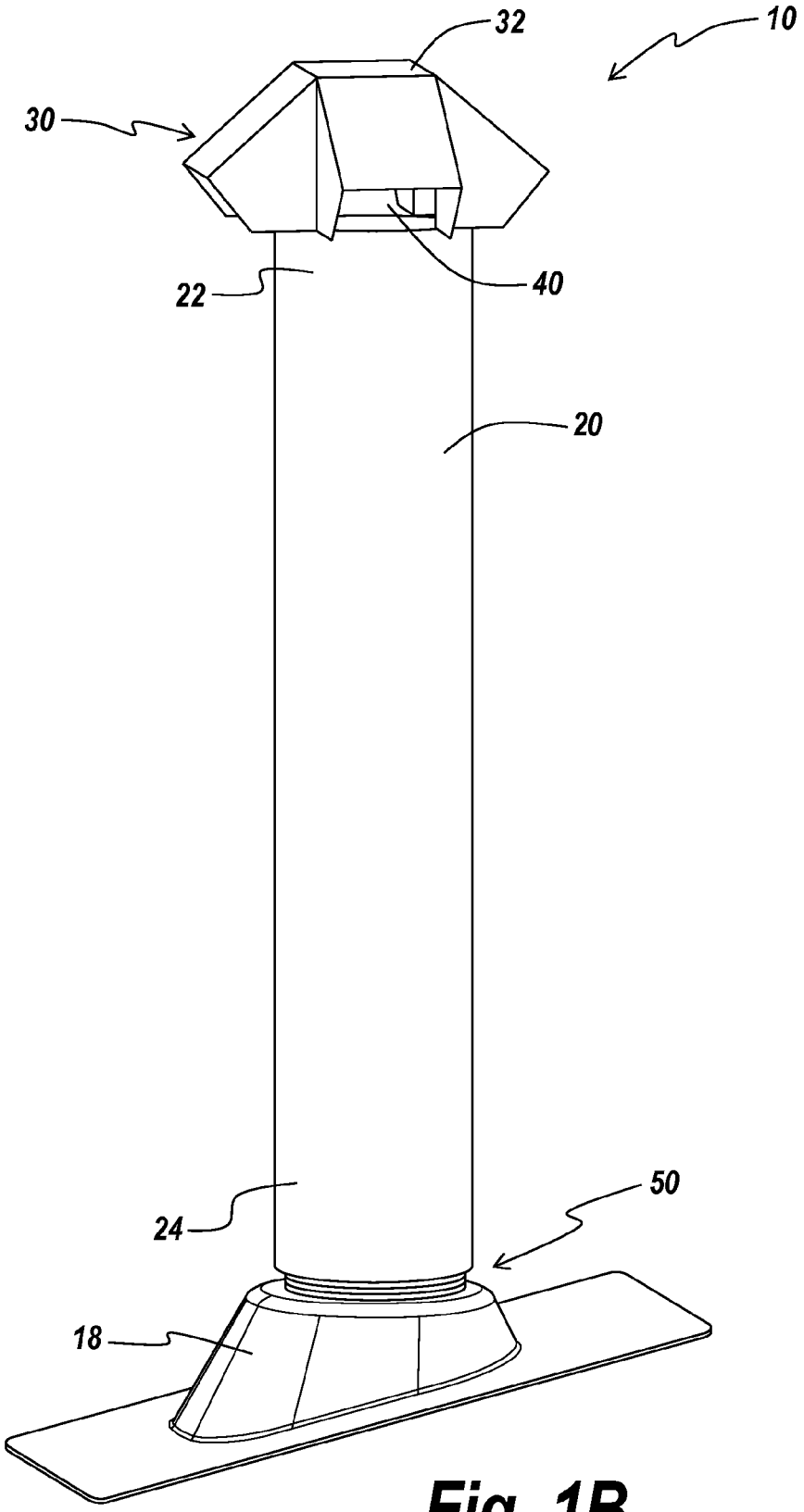
FIG. 1B is an isometric view illustration of a vent pipe covering apparatus 10, in accordance with the first exemplary embodiment of the present disclosure.

FIG. 1A is a cross-sectional diagrammatical illustration of a vent pipe covering apparatus 10, in accordance with a first exemplary embodiment of the present disclosure. FIG. 1B is an isometric view illustration of a vent pipe covering apparatus 10, in accordance with the first exemplary embodiment of the present disclosure. Relative to FIGS. 1A-1B, the vent pipe covering apparatus 10 which may be referred to herein as 'apparatus 10' includes a tubular structure 20 having a first end 22 and a second end 24, wherein the tubular structure 20 is positioned surrounding an exposed portion of a substantially vertical building roof-mounted vent pipe 12. A cap 30 is positioned at the first end 22 of the tubular structure 20. The cap 30 has a closed surface 32 positioned directly above the building roof-mounted vent pipe 12. A venting structure 40 is positioned in at least one of the tubular structure 20 and the cap 30. A connection system 50 is positioned between the tubular structure 20 and the building roof-mounted vent pipe 12 proximate to the second end 24 of the tubular structure 20, wherein the connection system 50 retains the tubular structure 20 stationary relative to the building roof-mounted vent pipe 12.

The apparatus 10 may be used to cover, fully or partially, an exposed portion of a substantially vertical building roof-mounted vent pipe 12. The building roof-mounted vent pipe 12 is commonly used for expelling plumbing gases from within a building or to allow the intake of atmospheric air into the building, among other uses. As is shown in FIG. 1A, the building roof-mounted vent pipe 12 is positioned substantially vertically within a building and extends through an interior part of the building, such as a room or an attic space 16, through the roof 14, and past the roof line e.g., the plane or level of the roofing shingles or other roofing materials.

Commonly, a building roof-mounted vent pipe 12 extends between one to three feet past the roof line which allows the opening of the building roof-mounted vent pipe 12 to be positioned higher than an average amount of snow which may accumulate on the roof. The exposed portion of the building roof-mounted vent pipe 12 is characterized as the portion of the building roof-mounted vent pipe 12 that is positioned above the roof line and thus is generally visible from a position outside of the building.

The building roof-mounted vent pipe 12 may be constructed from common building materials, usually a polyvinyl chloride (PVC) pipe used for household plumbing. As is known in the industry, a building roof-mounted vent pipe 12 constructed from PVC is often white in color and therefore highly visible when viewed in contrast to darker-colored roofing shingles. The building roof-mounted vent pipe 12 may have various widths, such as two, three, or four inches in diameter, various material thicknesses or material schedules, and various other features which accompany the building roof-mounted vent pipe 12. For example, a gasket 18 or flashing material is often used at the interface between the building roof-mounted vent pipe 12 and the roof 14 to prevent water, debris, or other items from gaining access to the building. Some gaskets 18 are rubber or plastic materials which snuggly fit around the exterior of the building roof-mounted vent pipe 12 and can be interlaced between the roof shingles. Metal-based flashing, or a combination of metal and rubberized materials, can be used in similar manners. Sealants, caulking, or similar substances may also be used to weatherize the building roof-mounted vent pipe 12 junction with the roof 14.

The tubular structure 20 may be a cylindrical or tube-shaped member which has a length measured between the first end 22 and the second end 24 which substantially exceeds a width or diameter measurement. Commonly the tubular structure 20 will have a circular cross-section, but other shapes may be included as well, such as square, hexagonal, or others. The tubular structure 20 may have a varied length, e.g., 28 inches, depending on the design, which allows it to extend beyond the building roof-mounted vent pipe 12. The tubular structure 20 may be a durable, weather-resistant, substantially rigid structure. Preferably, the tubular structure 20 is dark in color, such as black, brown, or dark gray, which allows it to match or blend in with the color of the building roof shingles. The tubular structure 20 may be constructed from materials such as PVC, plastics, metals, fiberglass, carbons, or others.

The tubular structure 20 can be installed on the building roof-mounted vent pipe 12 and is positioned substantially aligned with the building roof-mounted vent pipe 12, such that the two structures have substantially overlapping footprints. As discussed herein later, the tubular structure 20 may have an internal diameter measurement which is larger than an external diameter measurement of the building roof-mounted vent pipe 12 which allows the tubular structure 20 to slip over the building roof-mounted vent pipe 12. Other designs may include matching diameters. The connection system 50 is used to temporarily or permanently mount the tubular structure 20 to the building roof-mounted vent pipe 12, such that the tubular structure 20 covers at least a portion of the exposed portion of the building roof-mounted vent pipe 12. The connection system 50 may include a variety of different mechanical connections, described in detail relative to FIGS. 3A-7. The connection system 50 may be positioned, partially or fully, between the tubular structure 20 and the building roof-mounted vent pipe 12 near the second end 24 of the tubular structure 20 or in other locations along the tubular structure 20. In use, the connection system 50 retains the tubular structure 20 in a substantially stationary, fixed position relative to the building roof-mounted vent pipe 12.

The cap 30 includes a structure which is attachable or mountable (or integrally formed) at the first end 22 or top of the tubular structure 20. The cap 30 may be fastened to the first end 22 of the tubular structure 20 with any variety of fasteners, clips, or adhesives. The cap 30 includes a closed surface 32 positioned directly above the building roof-mounted vent pipe 12, such that it is located in an aligned overhead position with the building roof-mounted vent pipe 12. The closed surface 32 may be fully closed such that it prevents rain, other precipitation, or debris (leaves, etc.) from entering the building roof-mounted vent pipe 12 from a vertical or substantially vertical position. The cap 30 may include one or more venting structures 40 positioned therein in portions of the cap that are not in overhead alignment with the building roof-mounted vent pipe 12. For example, in FIG. 1A, it is shown that the venting structures 40 are positioned radially about the cap 30 a spaced distance from a footprint of the building roof-mounted vent pipe 12. It is noted that movement of rain or precipitation in a non-vertical direction, such as due to windy conditions, may gain access to the building roof-mounted vent pipe 12 through side-mounted or otherwise mounted venting structures 40, the quantity of which is considered insubstantial.

The venting structure 40 may be positioned in the tubular structure 20, in the cap 30, or in both the tubular structure 20 and the cap 30. The venting structure 40 includes an open path for gases and other materials to flow into and out from the building roof-mounted vent pipe 12 substantially unobstructed. It is noted that the venting structure 40 may include a screening or other material to limit debris or creatures from entering through the venting structure and into the building roof-mounted vent pipe 12.

Figure 2A:
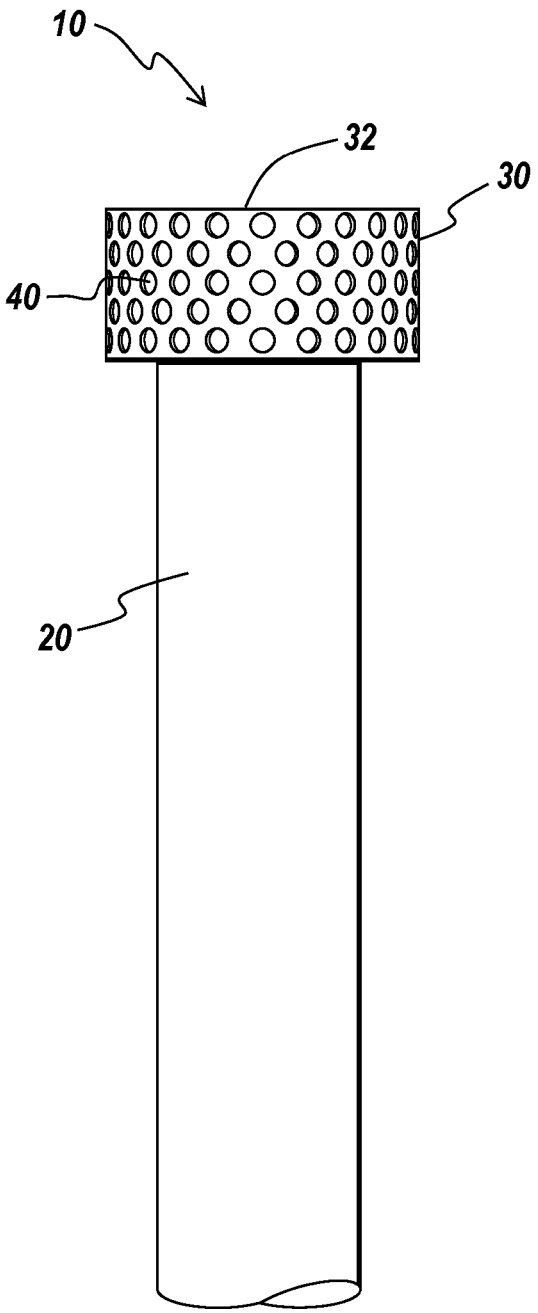
FIGS. 2A and 2B are front-view illustrations of a vent pipe covering apparatus having a perforated venting structure, in accordance with the first exemplary embodiment of the present disclosure.
Figure 2B:
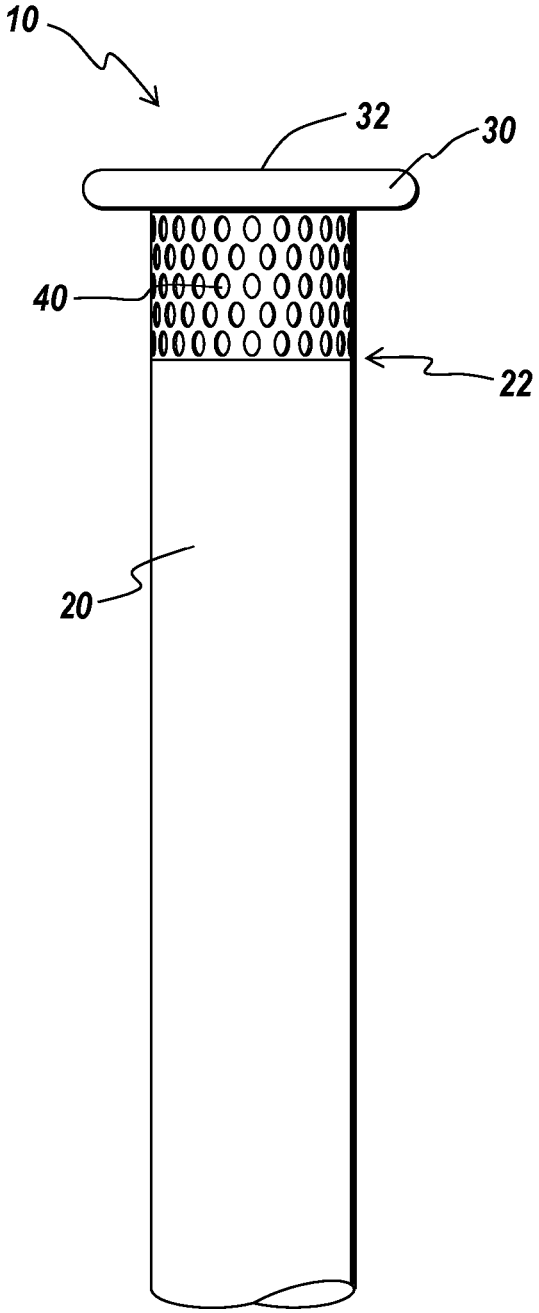

FIGS. 2A and 2B are front-view illustrations of a vent pipe covering apparatus 10 having a perforated venting structure 40, in accordance with the first exemplary embodiment of the present disclosure. As is shown, FIGS. 2A-2B each include venting structures 40 formed from perforated materials either in the cap 30, as shown in FIG. 2A, or in the tubular structure 20, as shown in FIG. 2B. The perforated material may include a plurality of small holes which are positioned spaced throughout a surface. The perforations forming the venting structure 40 of FIG. 2A may be positioned along a sidewall of the cap 30, radially about an axis of the cap 30. In this position, the top of the cap 30 can remain as a closed surface 32 to prevent the ingress of rain or other substances from entering the tubular structure 20. The cap 30 with the perforations may be sized to have a larger diameter than the tubular structure 20 itself. In FIG. 2B, the perforations are formed proximate to the first end 22 of the tubular structure 20, below where the cap 30 is affixed to the tubular structure 20. Again, the perforated venting structure 40 may be positioned radially about the tubular structure 20 with the cap 30 having the closed surface 32 positioned above it.

Figure 3A:
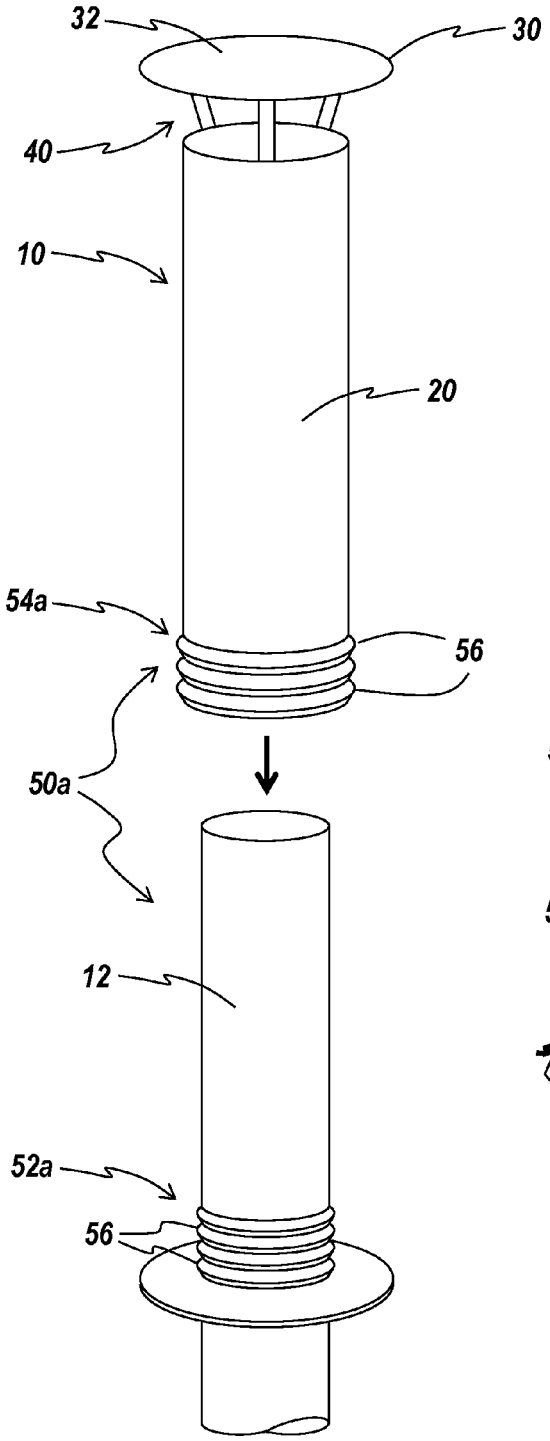
FIGS. 3A and 3B are front-view and cross-sectional view illustrations, respectively, of a vent pipe covering apparatus having a snap ring connection system as the connection system of FIGS. 1A-1B, in accordance with the first exemplary embodiment of the present disclosure.
Figure 3B:
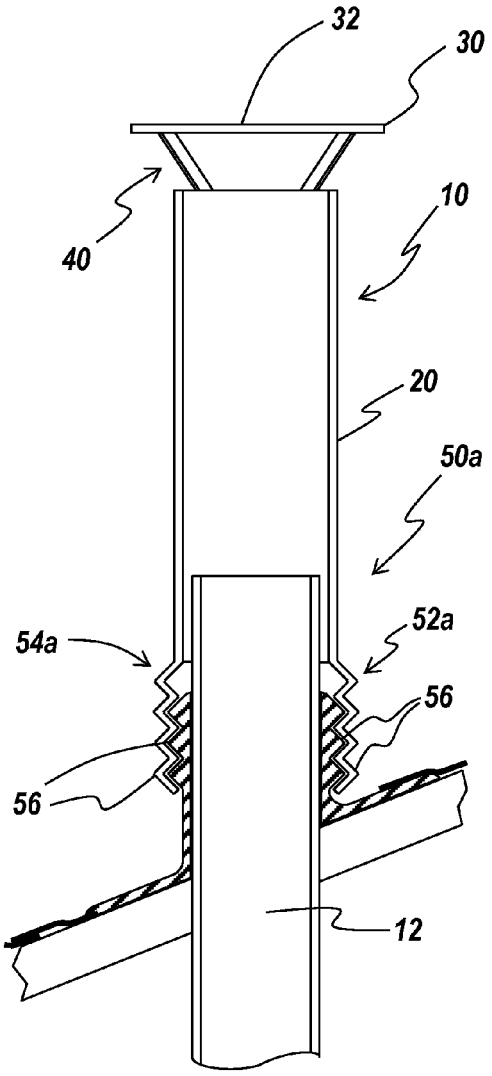

FIGS. 3A and 3B are front-view and cross-sectional view illustrations, respectively, of a vent pipe covering apparatus 10 having a snap ring connection system 50*a* as the connection system 50 of FIGS. 1A-1B, in accordance with the first exemplary embodiment of the present disclosure. The snap ring connection system 50*a* may include a snap ring receiver 52*a* positioned about the building roof-mounted vent pipe 12 and a snap ring connector 54*a* positioned proximate to the second end 24 of the tubular structure 20. The snap ring receiver 52*a* may be formed integral with an existing or new gasket used to interface between the building roof-mounted vent pipe 12 and the roof, and the snap ring connector 54*a* may be formed separate from or integral with the tubular structure 20. The snap ring receiver 52*a* includes at least one stepped protrusion 56 which can engage with at least one stepped protrusion 56 on the snap ring connector 54*a*. Accordingly, the stepped protrusions 56 on each of the snap ring receiver 52*a* and snap ring connector 54*a* can mate or mechanically engage, as shown in FIG. 3B, to retain the tubular structure 20 to the building roof-mounted vent pipe 12. This engagement may be created by placing the tubular structure 20 with the snap ring connector 54*a* over the building roof-mounted vent pipe 12 and forcing it downwards. The snap ring receiver 52*a* may contract slightly to receive the snap ring connector 54*a* over it, such that two or more stepped protrusions 56 achieve engagement. The connection between the stepped protrusions 56 may create a watertight seal and prevent precipitation, debris, or creatures from accessing the building roof-mounted vent pipe 12.

Figure 9:
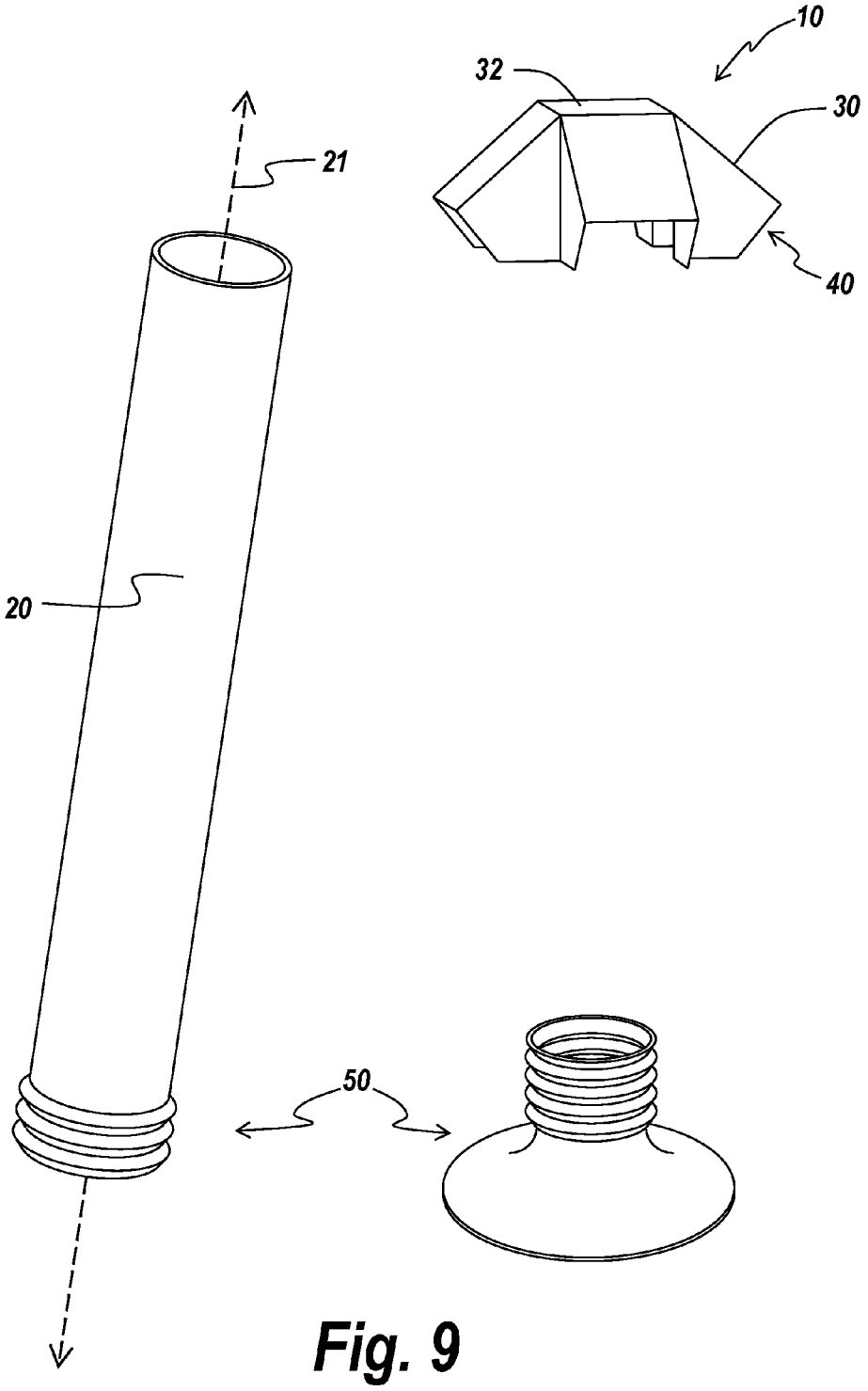
FIG. 9 is an isometric view illustration of a vent pipe covering of FIGS. 1A-1B presented as a vent pipe covering kit, in accordance with the first exemplary embodiment of the present disclosure.

It is noted that the snap ring receiver 52*a* and snap ring connector 54*a* may include additional features or designs. For example, instead of the snap ring connector 54*a* being positioned exterior of the snap ring receiver 52*a*, it may be positioned on an interior side of the snap ring receiver 52*a*. The snap ring receiver 52*a* and connector 54*a* may be formed from rubbers, plastics, or other gasket materials. In one example, the snap ring receiver 52*a* may be retrofitted on an existing building roof-mounted vent pipe 12 by slipping it over the end of the building roof-mounted vent pipe 12. In another example, the snap ring receiver 52*a* may be integrally formed with a gasket used on the building roof-mounted vent pipe 12 during an initial installation or renovation. In this situation, the snap ring receiver 52*a* may include a lower flange, as is shown in FIG. 9, to interleave between the roofing shingles.

Figure 4A:
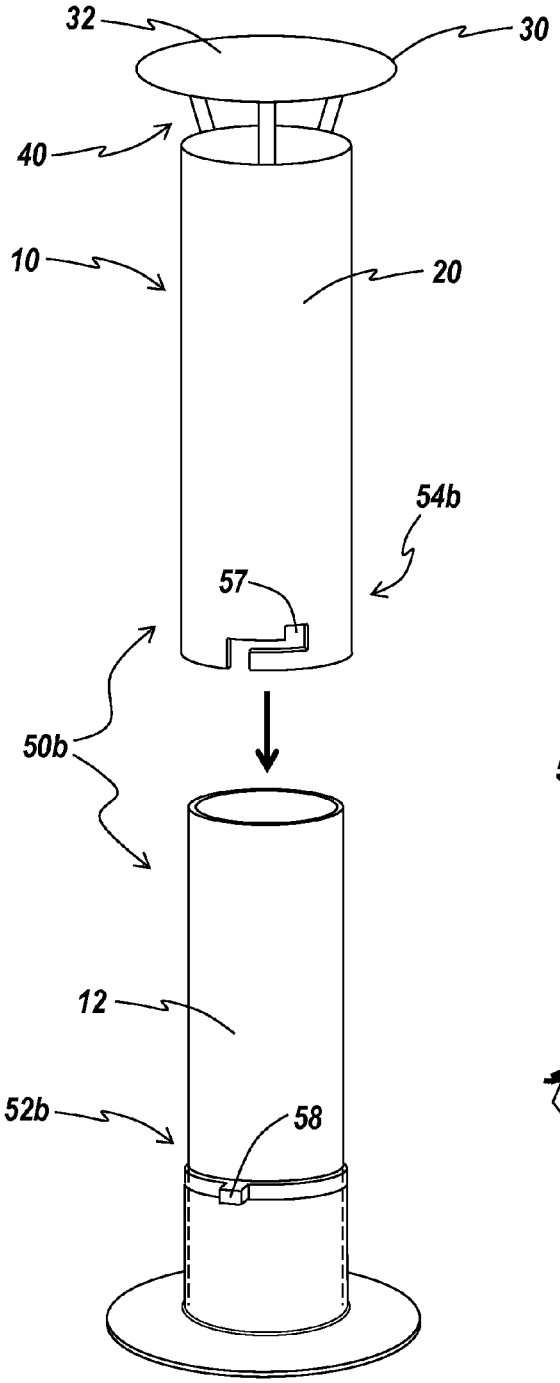
FIGS. 4A and 4B are front-view and cross-sectional view illustrations, respectively, of a vent pipe covering apparatus having a rotating lock connection system as the connection system of FIGS. 1A-1B, in accordance with the first exemplary embodiment of the present disclosure.
Figure 4B:
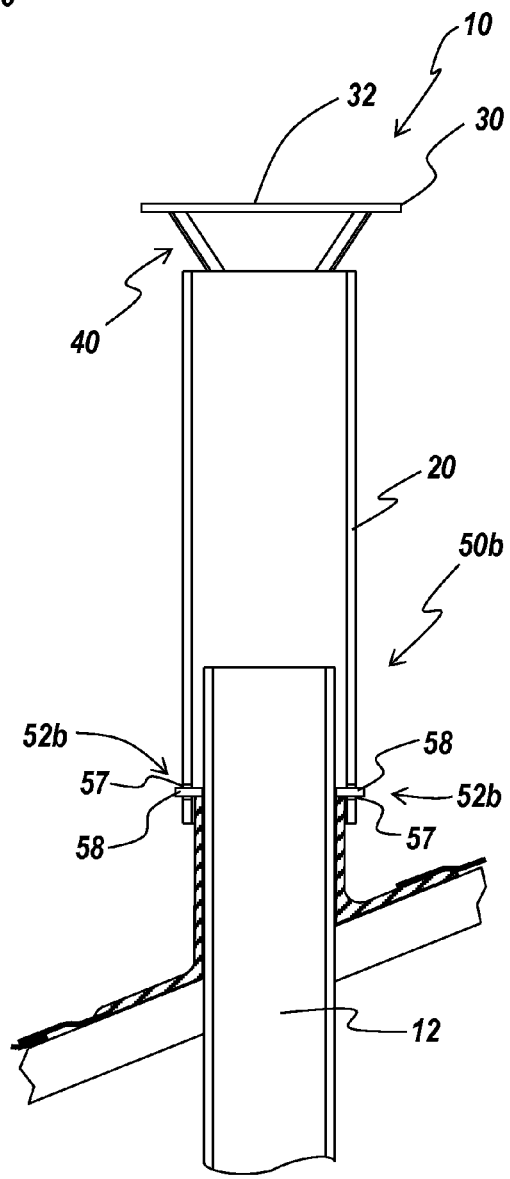

FIGS. 4A and 4B are front-view and cross-sectional view illustrations, respectively, of a vent pipe covering apparatus 10 having a rotating lock connection system 50*b* as the connection system 50 of FIGS. 1A-1B, in accordance with the first exemplary embodiment of the present disclosure. The rotating lock connection system 50*b* may include a rotating lock connector 52*b* positioned about the building roof-mounted vent pipe 12 and a rotating lock receiver 54*b* positioned proximate to the second end 24 of the tubular structure 20. The rotating lock connector 52*b* may be formed integral with an existing or new gasket used to interface between the building roof-mounted vent pipe 12 and the roof, and the rotating lock receiver 54*b* may be formed separate from or integral with the tubular structure 20. The rotating lock connector 52*b* includes at least one slot 57, such as an angled or stepped slot, which can engage with at least one tab 58 on the rotating lock receiver 54*b*.

Any number of slots 57 may be used; commonly two or four may be present. The slot 57 may be sized to receive the tab 58 positioned on the rotating lock receiver 54*b* such that the tab 58 can mechanically engage, as shown in FIG. 4B, to retain the tubular structure 20 to the building roof-mounted vent pipe 12. This engagement may be created by placing the tubular structure 20 with the rotating lock receiver 54*b* over the building roof-mounted vent pipe 12 and rotating it while guiding it downwards. The tabs 58 may rotate with the rotation of the tubular structure 20, thereby moving them into the slots 57. The connection between the tabs 58 and the slot 57 may have a sufficient tolerance to ensure there is a frictional engagement therebetween. The connection between the rotating lock connector 52*b* and the rotating lock receiver 54*b* may create a watertight seal and prevent precipitation, debris, or creatures from accessing the building roof-mounted vent pipe 12.

It is noted that the rotating lock connector 52*b* and rotating lock receiver 54*b* may include additional features or designs. For example, instead of the rotating lock receiver 54*b* being positioned exterior of the rotating lock connector 52*b*, it may be positioned on an interior side of the rotating lock connector 52*b*. Further, the top of the rotating lock connector 52*b* may lay flush with a sidewall of the tubular structure 20 to prevent water or other items from gaining access to the building roof-mounted vent pipe 12. The connection may include a sealing structure, such as a rubberized gasket or washer positioned between the rotating lock connector 52*b* and the rotating lock receiver 54*b*. The rotating lock connector 52*b* and receiver 54*b* may be formed from rubbers, plastics, or other gasket materials. In one example, the rotating lock connector 52*b* may be retrofitted on an existing building roof-mounted vent pipe 12 by slipping it over the end of the building roof-mounted vent pipe 12. In another example, the rotating lock connector 52*b* may be integrally formed with a gasket used on the building roof-mounted vent pipe 12 during an initial installation or renovation. In this situation, the rotating lock connector 52*b* may include a lower flange, as is shown in FIG. 9, to interleave between the roofing shingles.

Figure 5A:
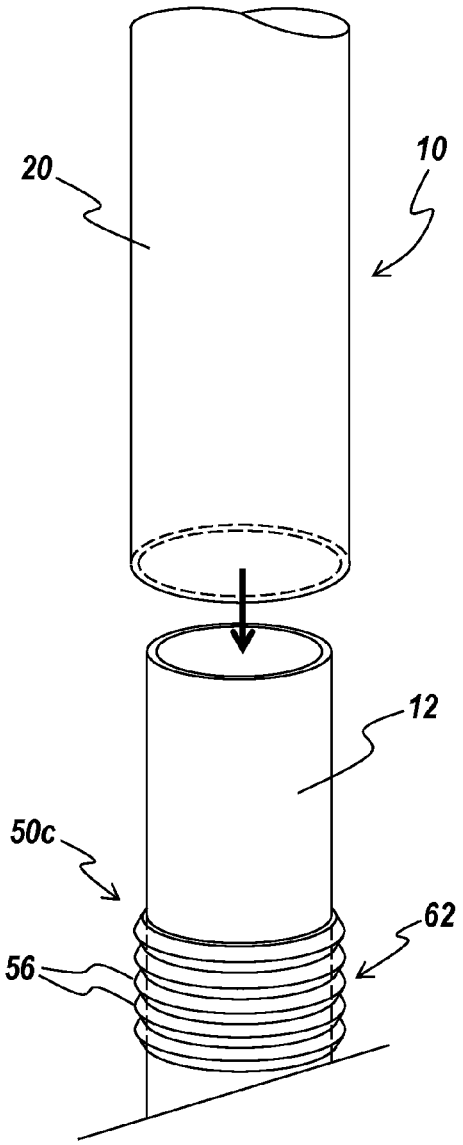
FIGS. 5A and 5B are front-view and cross-sectional view illustrations, respectively, of a vent pipe covering apparatus having a friction sleeve connection system as the connection system of FIGS. 1A-1B, in accordance with the first exemplary embodiment of the present disclosure.
Figure 5B:
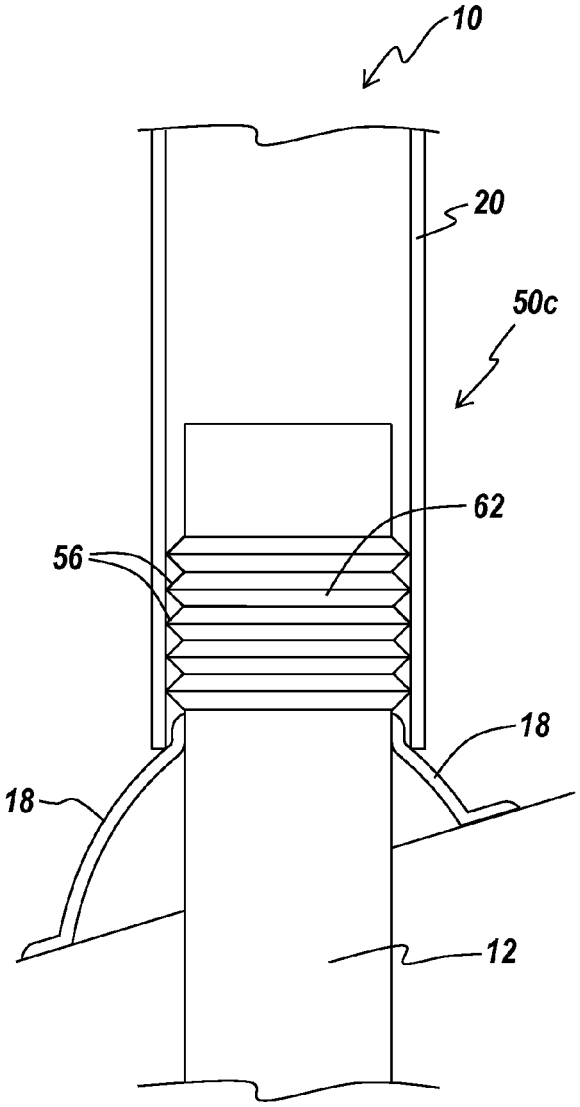

FIGS. 5A and 5B are front-view and cross-sectional view illustrations, respectively, of a vent pipe covering apparatus 10 having a friction sleeve connection system 50*c* as the connection system 50 of FIGS. 1A-1B, in accordance with the first exemplary embodiment of the present disclosure. The friction sleeve connection system 50*c* may include a sleeve 62 which has an inner diameter sized to match an outer diameter of the building roof-mounted vent pipe 12. The sleeve 62 may be placed on the building roof-mounted vent pipe 12 and slide down along the building roof-mounted vent pipe 12 to an appropriate position. Preferably, the sleeve 62 is formed from rubber, plastic, or a similar material which allows the sleeve 62 to snugly be retained on the building roof-mounted vent pipe 12. An exterior surface of the sleeve 62 may include stepped protrusions 56 or similar structures which are adapted to engage with an inner surface of the tubular structure 20 when it is positioned on the building roof-mounted vent pipe 12 and in contact with the sleeve 62. For example, the stepped protrusions 56 may be frictionally contacted by the tubular structure 20, as shown in FIG. 5B, which biases the sleeve 62 between the building roof-mounted vent pipe 12 and the tubular structure 20. The frictional engagement between the building roof-mounted vent pipe 12 and the tubular structure 20 through the sleeve 62 may be sufficient to retain the tubular structure 20 on the building roof-mounted vent pipe 12.

As is shown in FIG. 5B, the sleeve 62 may be especially useful when retrofitting the apparatus 10 on an existing building roof-mounted vent pipe 12. In this situation, the installer may position the sleeve 62 to substantially abut the edge of the existing gasket 18. When the tubular structure 20 is forced down on the building roof-mounted vent pipe 12 and engages the sleeve 62, the lower edge of the tubular structure 20 may be positioned over the edge of the existing gasket 18.

Figure 6B:
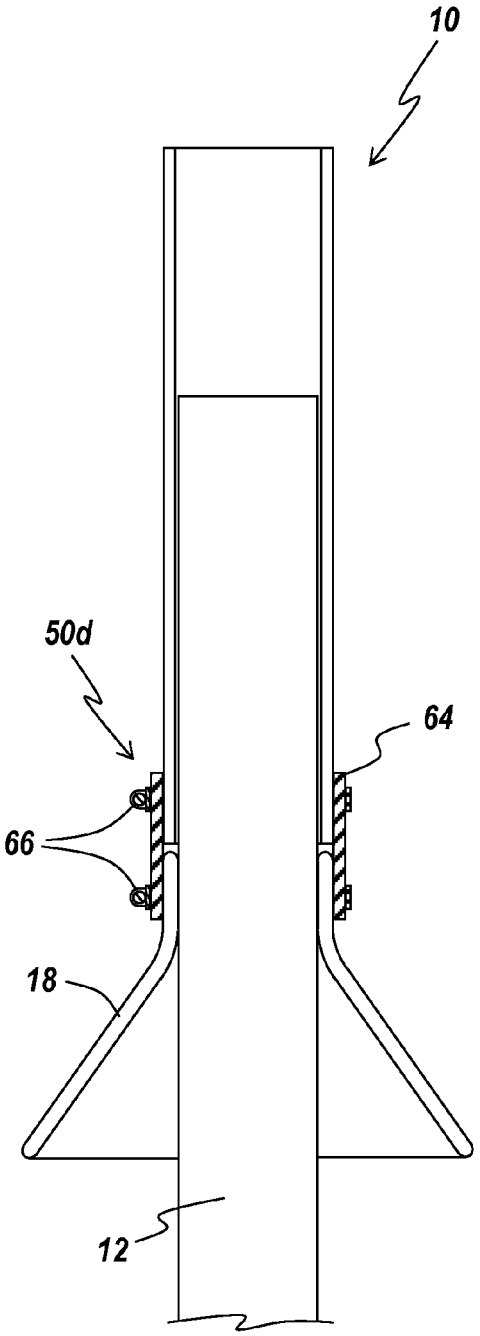
FIGS. 6A and 6B are front-view and cross-sectional view illustrations, respectively, of a vent pipe covering apparatus having a clamped sleeve connection system as the connection system of FIGS. 1A-1B, in accordance with the first exemplary embodiment of the present disclosure.
Figure 6A:
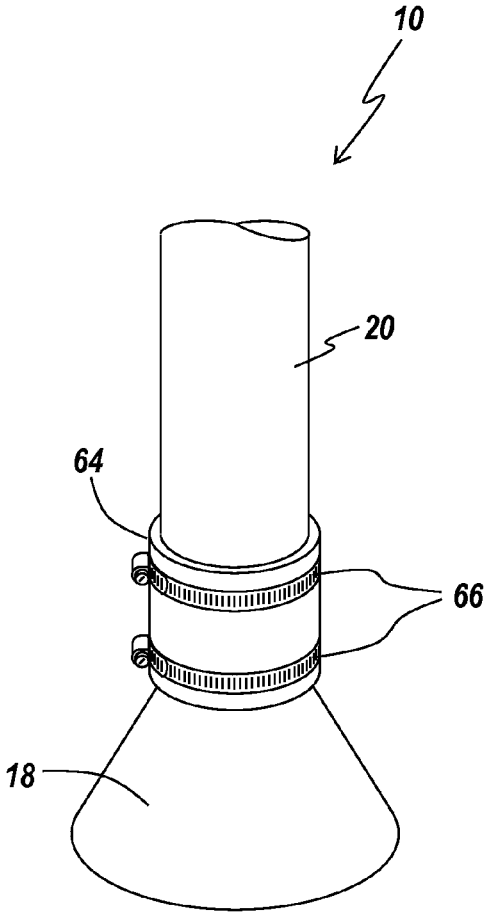

FIGS. 6A and 6B are front-view and cross-sectional view illustrations, respectively, of a vent pipe covering apparatus 10 having a clamped sleeve connection system 50*d* as the connection system 50 of FIGS. 1A-1B, in accordance with the first exemplary embodiment of the present disclosure. The clamped sleeve connection system 50*d* may use a coupling 64 which can be retained at a junction between the tubular structure 20 and the building roof-mounted vent pipe 12, as shown in FIGS. 6A-6B. When the tubular structure 20 is positioned over the building roof-mounted vent pipe 12, the coupling 64 may be slid over the tubular structure 20 until it is positioned over the junction between the tubular structure 20 and the building roof-mounted vent pipe 12. It may be common for the coupling 64 to be positioned over a portion of the existing gasket 18 for the building roof-mounted vent pipe 12, such as the edge of the gasket 18. One or more ring clamps 66 or similar devices may then be positioned around the coupling 64 to retain it in place on the junction. Similar to the friction sleeve connection system 50*c* of FIGS. 5A-5B, the clamped sleeve connection system 50*d* may provide easy installation of the apparatus 10 when it is being retrofitted on an existing building roof-mounted vent pipe 12.

Figure 7:
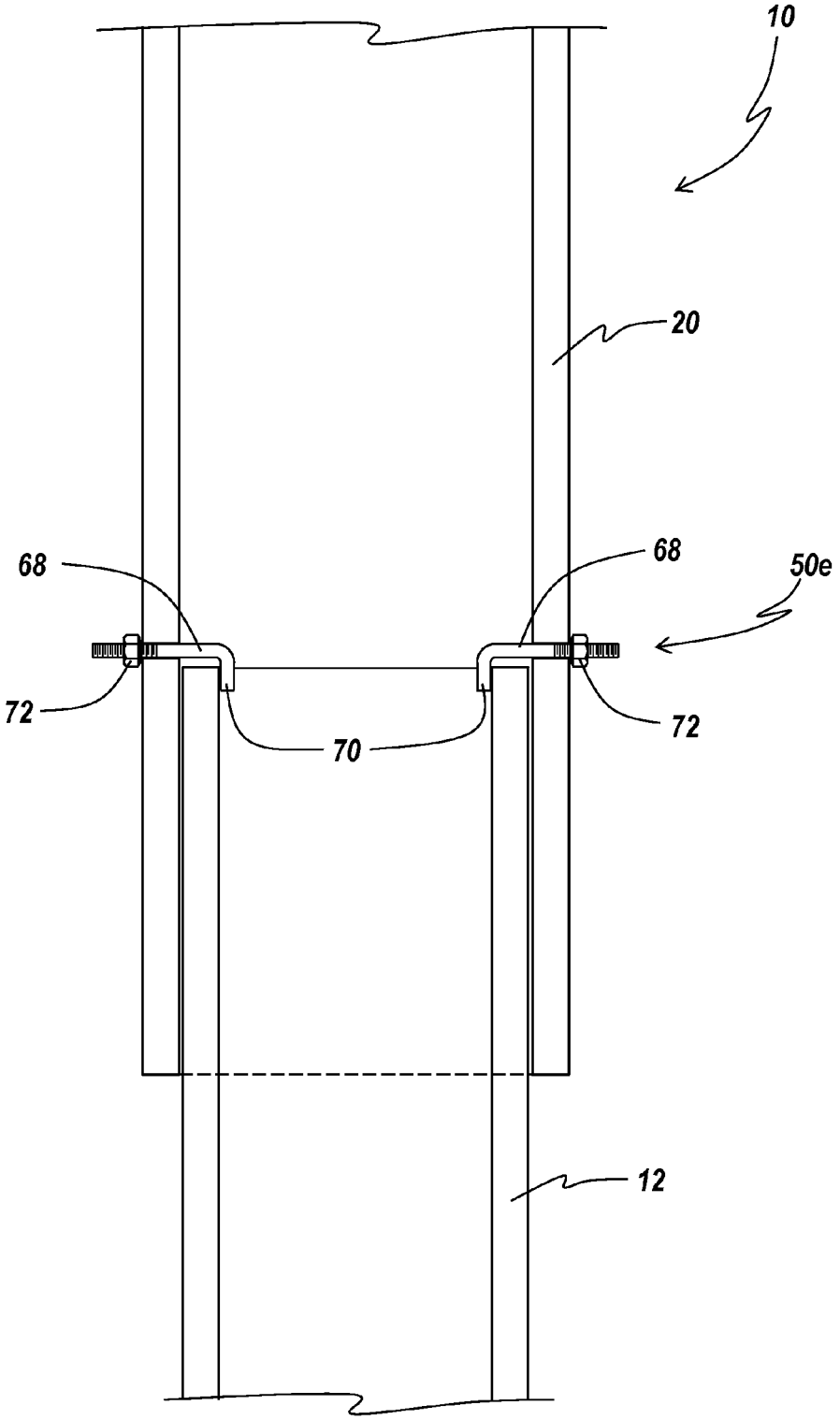
FIG. 7 is a cross-sectional view illustration of a vent pipe covering apparatus having a threaded fastener connection system as the connection system of FIGS. 1A-1B in accordance with the first exemplary embodiment of the present disclosure.

FIG. 7 is a cross-sectional view illustration of a vent pipe covering apparatus 10 having a threaded fastener connection system 50*e* as the connection system 50 of FIGS. 1A-1B, in accordance with the first exemplary embodiment of the present disclosure. The threaded fastener connection system 50*e* may include one or more threaded fasteners 68 which can engage between the tubular structure 20 and the building roof-mounted vent pipe 12. The threaded fasteners 68 can have pointed ends (not shown) which are driven through the tubular structure 20 and into the building roof-mounted vent pipe 12. In contrast, as is shown in FIG. 7, the threaded fasteners 68 may be formed with, or otherwise connected to, angled brackets 70 which, instead of being positioned through the building roof-mounted vent pipe 12, can engage with the opening of the building roof-mounted vent pipe 12.

Specifically, the threaded fasteners 68 can be positioned through a hole within the tubular structure 20 with the angled brackets 70 located interior of the tubular structure 20. The angled brackets 70 can be slipped over the opening of the building roof-mounted vent pipe 12 such that they slightly enter an interior of the building roof-mounted vent pipe 12. Then, nuts 72 or similar structures positioned outside of the tubular structure 20, can be rotated to tighten the threaded fasteners 68, thereby biasing the angled brackets 70 outwards to retain the tubular structure 20 against the building roof-mounted vent pipe 12. Similar to the friction sleeve connection system 50*c* of FIGS. 5A-5B and the clamped sleeve connection system 50*d* of FIGS. 6A-6B, use of the threaded fasteners 68 may provide easy installation of the apparatus 10 when it is being retrofitted on an existing building roof-mounted vent pipe 12. Notably, the ability to retrofit the apparatus 10 without having to drill a hole or drive a fastener through the building roof-mounted vent pipe 12 may increase the ease at which the apparatus 10 can be installed.

Figure 8:
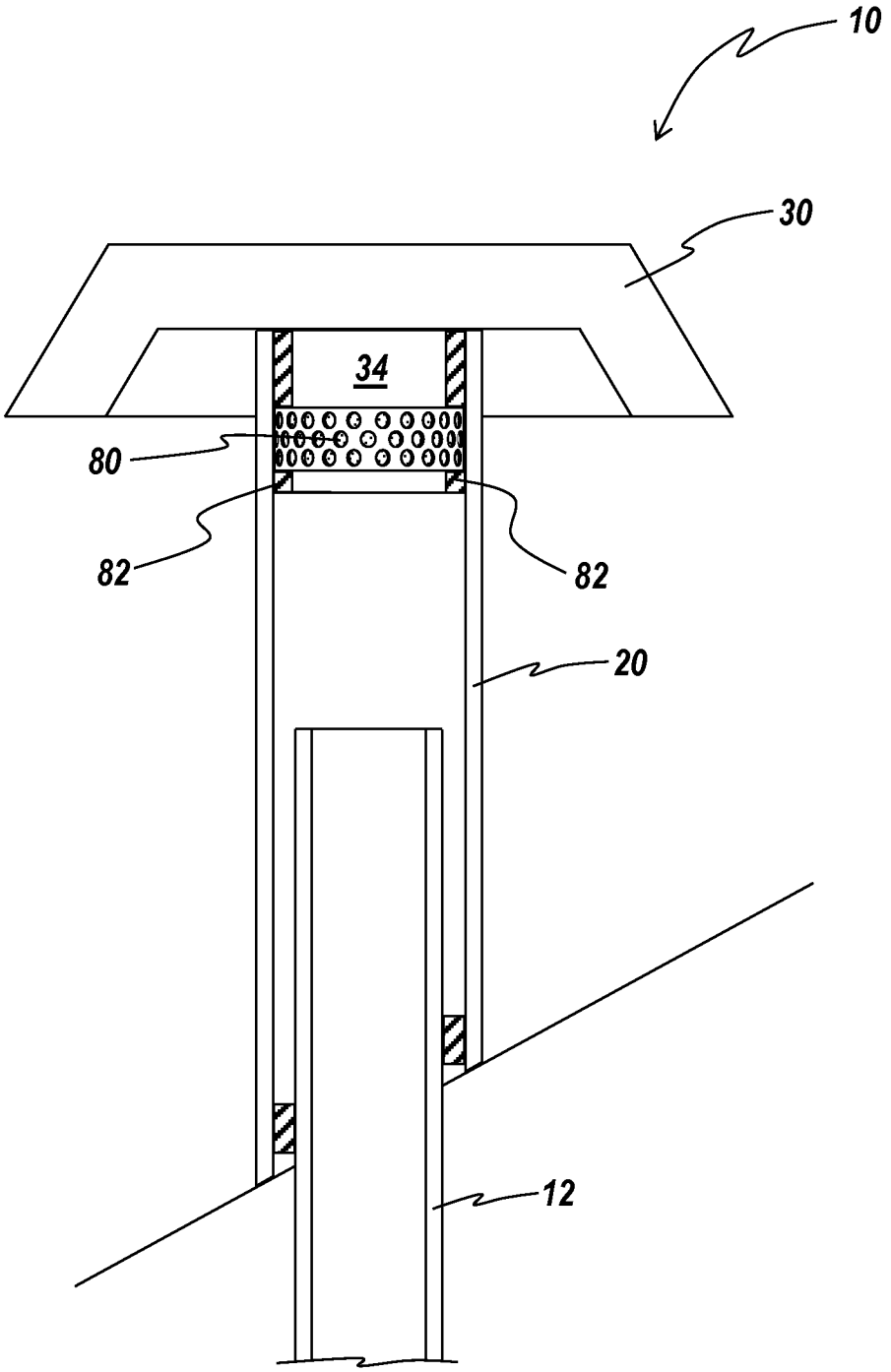
FIG. 8 is a cross-sectional view illustration of a vent pipe covering apparatus having an air filter, in accordance with the first exemplary embodiment of the present disclosure.

FIG. 8 is a cross-sectional view illustration of a vent pipe covering apparatus 10 having an air filter 80, in accordance with the first exemplary embodiment of the present disclosure. The air filter 80 may be positioned within a gas flow pathway within the tubular structure 20, such that it can filter gases and air that move through the tubular structure 20. The air filter 80 may be connected to the cap 30 or positioned within the first end 22 of the tubular structure 20, such that it can be easily accessed for periodic replacements. When the air filter 80 is affixed to the cap 30, it may be retrievable from the tubular structure 20 when the cap 30 is removed. The cap 30 may include a lower extension 34 which descends into the tubular structure 20 and retains the air filter 80. Additionally, when the air filter 80 is either connected or not connected to the cap 30, it may be positioned against a retaining shelf 82, such as inward tabs or an inward-extending ring, which retains the air filter 80 at a predetermined position along the height of the tubular structure 20.

The air filter 80 may be constructed from a variety of filtering materials, including carbon-based materials, fabric-based materials, or any combination thereof. The air filter 80 may help eliminate or minimize undesirable odors which are emitted by gas that is exiting the building roof-mounted vent pipe 12. The need to minimize or eliminate odors may be especially desired when the building roof-mounted vent pipe 12 is positioned near a deck, porch, or other outdoor area which is located near the building roof-mounted vent pipe 12. It is noted that while insect screens and guards may be used conventionally within the industry to prevent creatures from accessing the building roof-mounted vent pipe 12 (which the air filter 80 may also perform the function of), the air filter 80 filters gases that are unfiltered by screens, guards, or mesh components which are designed to allow air to pass there through unobstructed.

FIG. 9 is an isometric view illustration of a vent pipe covering 10 of FIGS. 1A-1B presented as a vent pipe covering kit, in accordance with the first exemplary embodiment of the present disclosure. The vent pipe covering kit may be comprised of a tubular structure 20 having a first end 22 and a second end 24, wherein the tubular structure 20 has a diameter of at least four inches. A cap 30 is adapted to be connected to the first end 22 of the tubular structure 20, wherein the cap 30 has a closed surface 32. The closed surface 32 is adapted to be positioned intersecting a central axis 21 of the tubular structure 20 when the cap 30 is connected to the tubular structure 20. A venting structure 30 is formed in at least one of the tubular structure 20 and the cap 30. A mechanical connection device 40 is adapted to engage between the tubular structure 20 and a building roof-mounted vent pipe 12 to retain the tubular structure 20 stationary relative to the building roof-mounted vent pipe 12. The vent pipe covering kit may include any of the features discussed herein relative to any other figure. The vent pipe covering kit may be packaged and sold as individual components which are assembled by a user during installation of the apparatus 10.

Figure 10:
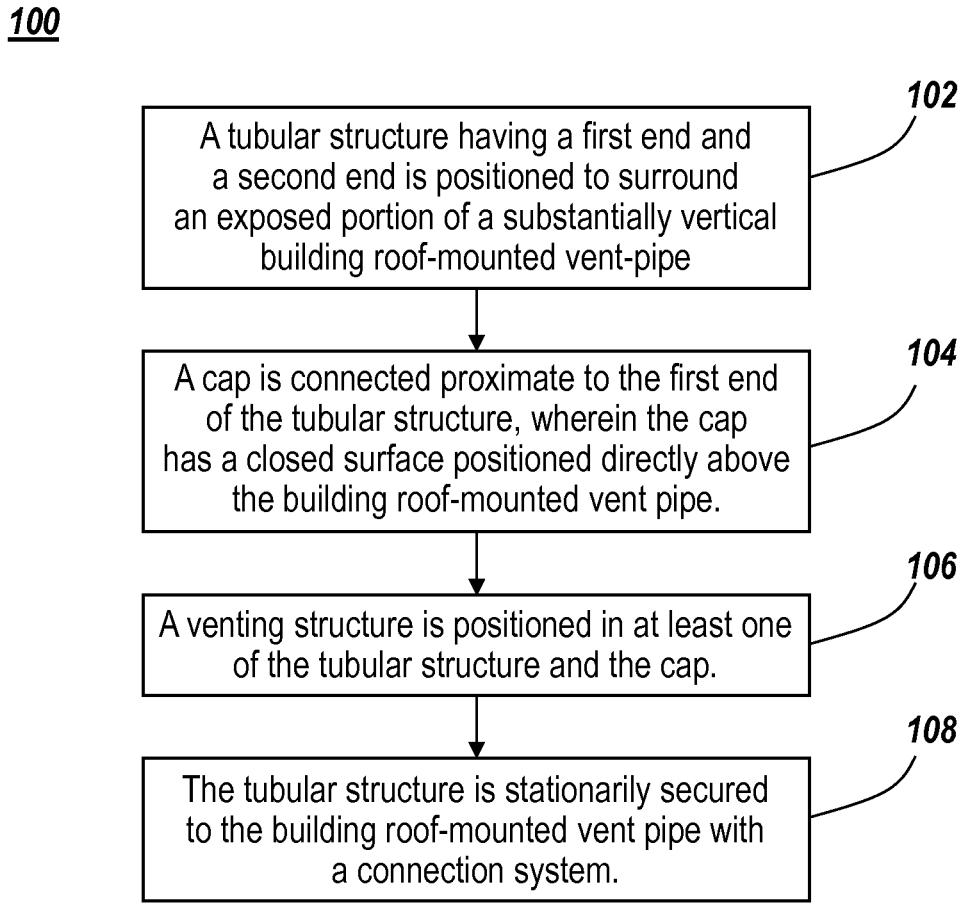
FIG. 10 is a flowchart illustrating a method of covering a building roof-mounted vent pipe, in accordance with the first exemplary embodiment of the disclosure.

FIG. 10 is a flowchart 100 illustrating a method of covering a building roof-mounted vent pipe, in accordance with the first exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a tubular structure having a first end and a second end is positioned to surround an exposed portion of a substantially vertical building roof-mounted vent pipe. A cap is connected proximate to the first end of the tubular structure, wherein the cap has a closed surface positioned directly above the building roof-mounted vent pipe (block 104). A venting structure is positioned in at least one of the tubular structure and the cap (block 106). The tubular structure is stationarily secured to the building roof-mounted vent pipe with a connection system (block 108). The method may include any additional number of steps, processes, or functions, including any disclosed relative to any figure herein.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A vent pipe covering apparatus comprising: a tubular structure having a first end and a second end, wherein the tubular structure is positioned surrounding an exposed portion of a substantially vertical building roof-mounted vent pipe;

a cap positioned at the first end of the tubular structure, the cap having a closed surface positioned directly above the building roof-mounted vent pipe;

a venting structure positioned in at least one of the tubular structure and the cap; and a snap ring connection system positioned between the tubular structure and the building roof-mounted vent pipe, wherein the snap ring connection system comprises a snap ring receiver and a snap ring connector, each having at least two stepped protrusions, wherein the at least two stepped protrusions of each of the snap ring receiver and the snap ring connector engage together to retain the tubular structure stationary relative to the building roof-mounted vent pipe, wherein the snap ring receiver is positioned integral with a gasket of the building roof-mounted vent pipe.

2. The vent pipe covering apparatus of claim 1, wherein the venting structure further comprises a perforated wall of the cap.

3. The vent pipe covering apparatus of claim 1, wherein the snap ring receiver is positioned about the building roof-mounted vent pipe and the snap ring connector is positioned proximate to the second end of the tubular structure.

4. The vent pipe covering apparatus of claim 3, wherein the at least two stepped protrusions of each of the snap ring receiver and the snap ring connector further comprise at least three stepped protrusions of each of the snap ring receiver and the snap ring connector engage together.

5. The vent pipe covering apparatus of claim 1, wherein the at least two stepped protrusions of the snap ring receiver are positioned on an outer-facing surface of the gasket, wherein an inward-facing surface of the gasket is sealed against the building roof-mounted vent pipe.

6. The vent pipe covering apparatus of claim 1, wherein the at least two stepped protrusions of the snap ring receiver are positioned on an outer-facing surface of the gasket, and wherein an inward-facing surface of the gasket comprises a substantially straight, non-stepped surface along a vertical length of the building roof-mounted vent pipe.

7. The vent pipe covering apparatus of claim 1, wherein the gasket further comprises a resilient material, wherein the gasket extends along a vertical sidewall of the building roof-mounted vent pipe.

8. The vent pipe covering apparatus of claim 1, wherein the gasket further comprises a lower flange, wherein the lower flange is positioned interleaved with roofing shingles.

9. The vent pipe covering apparatus of claim 1, wherein an engagement of the at least two stepped protrusions of each of the snap ring receiver and the snap ring connector engage creates a watertight seal there between.

* * * * *